US005240763A

United States Patent [19]

Wagner et al.

[11] Patent Number: 5,240,763

[45] Date of Patent: Aug. 31, 1993

[54] DIMENSIONALLY STABLE PAPERMAKERS FABRIC

[75] Inventors: J. Robert Wagner, Norristown, Pa.; C. Barry Johnson, Summerville, S.C.

[73] Assignee: Asten Group, Inc., Charleston, S.C.

[21] Appl. No.: 351,187

[22] Filed: May 12, 1989

[51] Int. Cl.[5] ..... D03D 15/00; D21F 3/02; D21F 7/08; D21F 7/12

[52] U.S. Cl. ..... 428/222; 139/420 R; 139/420 A; 139/383 A; 162/358.1; 162/358.2; 162/902; 162/903; 428/229; 428/257; 428/258; 428/259

[58] Field of Search ..... 162/DIG. 1, 358, 358.1, 162/358.2, 902, 903; 428/222, 229, 257, 258, 259; 139/420 R, 420 A, 383 A

[56] References Cited

U.S. PATENT DOCUMENTS

| | | | |
|---|---|---|---|
| 3,473,576 | 10/1969 | Amneus | 139/420 |
| 3,815,645 | 6/1974 | Codorniu | 139/383 |
| 4,695,498 | 9/1987 | Sarrazin et al. | 428/121 |
| 4,755,420 | 7/1988 | Baker et al. | 428/222 |

FOREIGN PATENT DOCUMENTS

| | | |
|---|---|---|
| 0161579 | 11/1985 | European Pat. Off. . |
| 2164700 | 7/1972 | Fed. Rep. of Germany . |
| 2040326 | 8/1980 | United Kingdom . |

OTHER PUBLICATIONS

Choy, C. L., Thermal Expansivity of Oriented Polymers, *Developments In Oriented Polymers*, edited by Ian Ward, 1982, pp. 121-151.

*Primary Examiner*—James C. Cannon
*Attorney, Agent, or Firm*—Volpe & Koenig

[57] ABSTRACT

A papermakers fabric and method of designing and manufacturing same which exhibits high tolerance to temperature and/or moisture variation and as a result, retains dimensional stability avoiding these problems. A specific fabric construction is selected having a defined machine direction (MD) and cross machine direction (CMD) yarn components. A mathematical model of the selected fabric structure is then defined in terms of the dimensions of the yarn components in relationship to the machine direction length of the fabric. The percent change in fabric length is then determined as a function of both the dimensions and the expansion characteristics of the MD and CMD yarns. The fabric is then designed to have calculated expansion characteristics within selected tolerances.

11 Claims, 2 Drawing Sheets

DIMENSIONALLY STABLE PAPERMAKERS FABRIC

The present invention relates to papermakers fabrics and their method of manufacture.

BACKGROUND OF THE INVENTION

An Apparatus for papermaking generally includes three sections, formation, pressing and drying. Papermakers fabrics form and transport an aqueous paper web through the papermaking apparatus.

A forming fabric generally, consists of metallic wire and/or synthetic material such as nylon or polyester. In the formation of some paper grades, the water slurry may be heated to improve the drainage, formation or other desirable characteristics. As the forming fabric travels from the head box to couch in a papermaking machine, water is removed and both the sheet being formed and the forming fabric tend to cool in temperature. Further cooling of the forming fabric occurs in the return section. The addition of showers, either hot or cold, also influences temperature variations of the forming fabric. The abrupt change in temperature has been known to cause dimensional change in the length or width of the forming fabric which can, depending upon the material and construction used, be either a growth or shrinkage as the temperature changes. The change in the fabric dimension is typically very rapid and as a result, ridging, wrinkling, guiding and take-up problems can arise.

In the pressing section of a papermaking machine, the variation in temperature tends to be less drastic, however hot or cold showers used for cleaning the fabric or felt can cause rapid changes in the temperature of the felt. The change in temperature can cause the felt to wrinkle, guide poorly or cause a change in the porosity or permeability of the felt.

The drying section of a papermaking machine may consist of from one to as many as six sections with both top and bottom felt positions. Currently, some dryer felts have been installed in which the felt runs alternately on both the top and bottom positions. Drying is generally accomplished by heated drying cans which are from 4 to 6 feet in diameter. Alternatively, the sheet may be dried using a thru dryer, radiant heat and/or radio frequency.

Variations in temperature along the fabric in the machine direction or across the fabric in the cross direction can be considerable, both between various paper machines and within a given paper machine. The dryer fabric tends to increase in temperature as the fabric proceeds through the machine. The temperature across the dryer fabric in the cross-machine direction also tends to vary. The drive side of the paper machine or the back tends to restrict air flow because of the presence of gears, piping, etc. Whereas the front of the papermaking machine often is more open and permits air to flow freely. This differential between front and back tends to create a non-uniform temperature profile across the fabric. Also, when pocket ventilation is not uniform, moisture laden air is not removed and the moisture profile will vary in the cross-machine direction. The variations in moisture will cause differences in the temperature profile of both the dryer fabric and the paper sheet being produced Placement and operation of dryer can siphons and dryer can flanges are known to cause temperature differences.

Some dryer fabrics are woven as endless belts where the filling yarns serve as the machine direction yarn and the warp yarn as the cross-machine direction yarn. Most dryer fabrics are, however, woven as a flat belt in which the warp is the machine direction yarn and the filling is the cross-machine direction yarn. In such fabrics, it is common to form an endless fabric loop incorporating a clipper seam, pin seam or other joining means.

Some papermakers fabrics are non-woven. Fabrics have been used in papermaking which are comprised of helical spirals wherein the spirals are intermeshed and serially connected by pintles to form an endless belt, for example, see U.S. Pat. Nos. 4,528,236, 4,567,077 and 4,654,122.

In the past, many paper mills have experienced certain problems with papermakers fabrics during the papermaking operation. Some of the reported problems include snaking, guiding, bowing, yo-yo and instability such as distortion, wrinkling, slack middle, roping-up and slack edges.

Snaking is characterized by an oscillation or whipping action of the dryer fabric as it runs on the machine. Sometimes the side to side movement is inherent in the dryer fabric and occurs once for every revolution and at the exact same location of the fabric. Snaking may be caused by improper dryer fabric manufacture, poor installation technique, improper operating procedures and faulty equipment.

Guiding is the steering of the fabric so that it stays on the machine with only periodic and slight movement of the fabric side to side. Guiding is controlled by a mechanical guide paddle, air, light or other sensing device that detects movement of the fabric and then causes the movement of a guide roll to continuously maintain the proper position of the fabric on the machine.

Bowing is associated with the center of the fabric being offset either in a leading or trailing manner as the fabric runs on the machine.

The term "yo-yo" is associated with the fabric changing excessively in length from a sheet-on to a sheet-off condition. To counteract this movement, the take-up roll will move to maintain constant tension of the fabric.

Distortion usually is associated with small areas of the fabric being out of shape, cocked or otherwise misaligned.

The term "wrinkling", applies to creases, ridges or folds in the fabric and may either be straight in the machine direction of the fabric or occur diagonally across the fabric.

The term "slack middle", refers to when the fabric is slack or baggy in the running center of the fabric.

Roping-up is a term used when the fabric runs off the machine and gathers together in a narrow mass or band while it is still running.

The term "slack edge" is used when either the running back or front edge of the fabric is loose, droops or forms a continuous bulge while the remainder of the fabric is running flat or smooth.

The cause of many of these problems in the past was not clearly understood and only occasionally could one relate a particular fabric problem to a machine fault, failure of a guide roll mechanism, machine roll misalignment or other known fault. While all of these problems are a nuisance, consistent and proper fabric manufacturing methods tend to minimize many of the problems encountered.

One of the most serious problems with respect to woven fabrics is slack edges. Even when manufacturing conditions for the fabric are carefully controlled, the problem of slack edges will occur. The problem of slack edges shows itself when the center of the fabric is flat for its entire running length and the running edge or edges tend to bulge or droop. On some designs, the fabric may tend to be slack in the middle rather than on the edge, but this is an exception rather than the general rule. If edge slackness is excessive, the guide paddle will not operate properly and the fabric will run off the machine, causing possible damage to the fabric or even the paper machine itself. In the dryer section, the paper sheet may not be held in intimate contact with the dryer can and sheet cockle on the edge or other problems may occur. All of the problems cited tend to reduce running efficiency and increase costs.

A review of field performance data of woven fabrics has indicated that slack edges occur on the fabric front edge ten times more often than on the back edge of the fabric. Often when a machine is fully hooded, slack edges may only appear when the hood is raised, but disappear when the hood is lowered. Dryer can flanges are also known items that cause dryer can and fabric temperature differences. It was discovered that the front edge is more slack edge prone because the front edge of the machine is open and thus more subject to air drafts and temperature fluctuation. In the case of a hooded machine, when the hood is closed, the fabric tends to reach both moisture and temperature equilibrium and therefore, difficulties in fabric slackness occur less often.

A further study revealed that certain paper machines are more prone to have slack edges than others. Often, when the thick, closed, older, low permeability felts were run, they performed very well, however, when the newer high permeability open mesh fabrics are used, the fabric may have slack edges.

With respect to spiral fabrics, fabric failure due to lack of dimensional stability is much more frequent. Not only is there a relatively high rate of slack edge and slack middle problems, but spiral fabrics have demonstrated frequent problems with guiding, yo-yoing, snaking and oscillation.

SUMMARY OF THE INVENTION

The present invention provides a means of designing and manufacturing a papermakers fabric which exhibits high tolerance to temperature and/or moisture variation and as a result, retains dimensional stability avoiding these problems.

A specific weave pattern or other construction, such as linked spiral yarns, is selected having a defined machine direction (MD) and cross machine direction (CMD) yarn components. A mathematical model of the selected fabric structure is then defined.

The mathematical model is defined in terms of the dimensions of the yarn components in relationship to the machine direction length of the fabric. Preferably, the MD fabric length is defined as a function of length and diameter of the MD yarn components and the diameter of the CMD yarn components.

*MD* fabric length = *f*structure (*MD* yarn length, *MD* yarn diameter, *CMD* yarn diameter)

The percent change in fabric length is then determined as a function of both the dimensions and the expansion characteristics of the MD and CMD yarns.

% $\Delta MD$ fabric length = $f_{\Delta}$structure ($\Delta MD$ yarn length, $\Delta MD$ yarn diameter, $\Delta CMD$ yarn diameter) = $f_{\Delta}$structure($f'$(*MD* yarn length, *KlMD*), $f''$(*MD* yarn diameter, *KdMD*), $f'''$(*CMD* yarn diameter, *KdCMD*))

where:

Kd = diameter expansion characteristic; and

Kl = linear expansion characteristic.

The mathematical model can be formulated to account for use of MD and CMD yarns of different gage and/or material. It can also be formulated where there is more than one type of MD and/or CMD yarn employed. In such case the contribution and expansion characteristic of each of the MD and/or CMD yarns, as they contribute to the overall fabric length, are accounted for in the mathematical model.

Specific yarn dimensions for the selected fabric structure are then defined so that the change in machine direction length becomes a function of the yarn expansion characteristics.

% $\Delta MD$ fabric length = $f_{\Delta}$structure($f'$(*KlMD*), $f''$(*KdMD*), $f'''$(*KdCMD*))

Yarns are then selected for the MD yarn components and the CMD yarn components based upon the yarn's expansion characteristics in response to fluctuation in temperature, moisture or both. The yarn selection is made so that the dimensional change in fabric length, due to temperature and/or moisture fluctuation attributed to the change in the MD yarn length is compensated for by the change in the MD and CMD yarn diameters. Accordingly, the overall change in fabric length can be controlled and can be significantly different than the characteristic linear dimensional change of the MD yarn component from which the fabric is constructed.

Preferably, the fabric is comprised of monofilament synthetic yarns selected so that the calculated percent of expansion of fabric length ranges between +0.4% and −0.4% per 100° F., preferably between ±0.1% per 100° F. or less than 0.1% per 100% humidity. The range of expansion characteristics and calculations should be based upon the yarn's characteristics in the anticipated range of temperature and moisture for the particular application of the fabric. For example, a dryer fabric may experience temperature in the range of 70° F.–350° F., normally running at temperatures between 150° F.–250° F. Yarn characteristics should be determined in the 150° F.–250° F. range in such case.

Temperature fluctuations normally occur in papermakers fabrics' operational environment. Where the intended environment is also subject to substantial fluctuation in humidity, the yarn expansion characteristics for both temperature and moisture changes can be determined and used in determining the specific yarn selections.

It will be recognized by those of ordinary skill in the art that the expansion characteristics of monofilament synthetic yarns vary in accordance with the manufacturing process. In particular, the linear expansion characteristics of polymeric yarns is directly related to the draw of the yarn as it is made. See Choy, "Thermal Expansivity of Oriented Polymers", *Developments In Oriented Polymers*, edited by Ian Ward, 1982, pp. 121-151. Accordingly, when polymeric synthetic yarns are to be used, it is important that uniform manufacturing criteria is maintained in the manufacture of the yarn so that the yarn exhibits uniform expansion characteristics which will form the basis in the design of the papermakers fabric in accordance with the inventive method.

With respect to woven fabrics, if a machine direction yarn with a relatively high coefficient of expansion is selected, different cross machine yarns can be selected having a relatively high diameter expansion coefficient which will serve to counterbalance the linear expansion of the machine direction yarns thereby providing dimensional stability in the overall fabric length. With respect to spiral fabrics, the selection of the yarns to comprise the spirals and connecting pintles can similarly be made.

Alternatively, yarns having a predetermined coefficient of expansion can first be selected and the change of machine direction length can then be defined in terms of the yarn dimensions:

$$\%\ \Delta MD \text{ fabric length} = f_{\Delta}\text{structure}(f'(MD \text{ yarn length}), f''(MD \text{ yarn diameter}), f'''(CMD \text{ yarn diameter}))$$

The dimensions for the fabric structure, such as number of picks per inch in a woven fabric, and the diameter of the yarns is then selected such that the calculated change in the MD fabric length is within desired ranges. Defining fabric structure and yarn dimensions in this manner becomes more difficult if the expansivity characteristic of the yarns are dependent upon yarn diameter.

In practice, a combination of the two alternative methods of selecting yarns based on expansion characteristics and dimensions can be utilized. For example, for a selected fabric structure, a yarn having a defined diameter and known linear and diameter expansion characteristics can be initially specified as the MD yarn. Then the formulation of the change in MD fabric length becomes dependent on CMD yarn variables:

$$\%\ \Delta MD \text{ fabric length} = f_{\Delta}\text{structure}\ (f'''(CMD \text{ yarn diameter}, KdCMD))$$

or $$\%\ \Delta MD \text{ fabric length} = f_{\Delta}\text{structure}\ (f'(f^{*}(CMD \text{ yarn diameter})), f'''(CMD \text{ yarn diameter}, KdCMD))$$

where:

MD yarn length is related to the CMD yarn diameter in the formulation of the fabric structure, i.e.:

MD yarn length $= f^{*}$(CMD yarn diameter).

Accordingly, the CMD yarn dimensions and characteristics are selected such that the calculated change in MD fabric length is within desired ranges.

DETAILED DESCRIPTION OF THE PREFERRED EMBODIMENT

Figure 1:
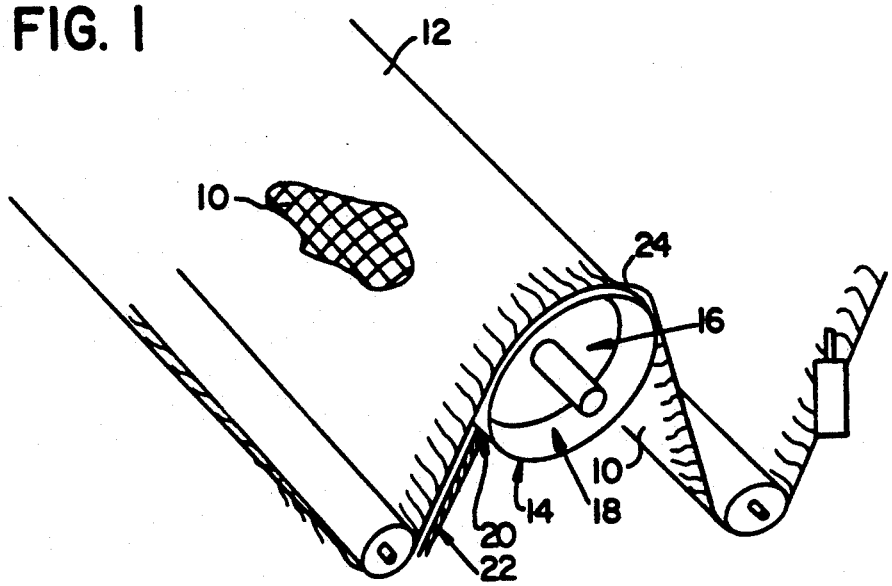
FIG. 1 is an illustration of a papermakers fabric passing over a dryer can.

Variations in temperature and moisture occur over both the length and width of a papermakers fabric 10 as they operate to form and/or transport a paper web 12 through papermaking machines. For example, referring to FIG. 1, a typical dryer can 14 has flanges 16 which tend to retain heat and often cause the fabric 10 to be hotter directly above the flanges 16. The dryer can 14 also has a dryer shell 18 extending beyond the flanges 16 with a groove 20 to facilitate the use of a rope 22 for threading the paper sheet tail through the dryer section. The extension of the shell 18 is not heated like the remainder of the dryer can 14 and, accordingly, the temperature will be substantially different between the end and the center of the dryer can 14. The temperature differences in the dryer can 14 cause the edge of the fabric to run cooler than the center of the fabric resulting in slack edges 24 if the machine direction length of the particular fabric design changes significantly due to the temperature differential. Similarly variations of moisture can effect the machine direction length of the fabric.

In studying the thermal properties of yarns and fabric, it was discovered that the thermal dimensional changes of a yarn is different in the diameter than it is in length. If the linear expansion characteristic is positive, the yarn gets longer when heated. However, some synthetic yarns have a positive diameter expansion characteristic and a negative linear expansion characteristic which means that the yarn swells in diameter and becomes shorter in length when heated.

Figure 2:
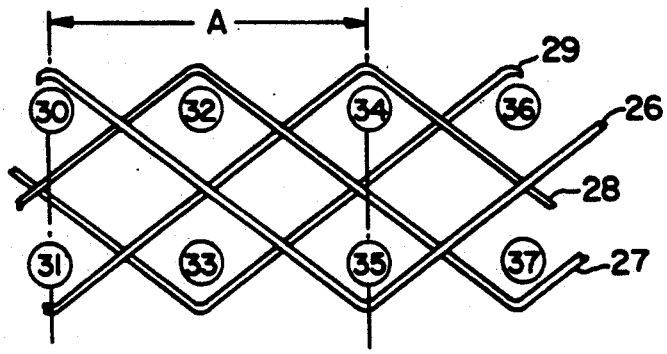
FIG. 2 is a schematic cross-sectional view of a section of a woven fabric.

With reference to FIG. 2, a woven dryer fabric structure is disclosed. The weave structure has warp yarns 26, 27, 28, 29 and filling yarns 30 through 37 woven in a repeat pattern as shown. A sample fabric was woven flat with warp yarns as the machine direction (MD) and the filling yarns as the cross-machine direction (CMD). The fabric was composed of 100% WP-500-7A, a monofilament polyester yarn manufactured by Shakespeare Corporation.

Dimensional stability was tested by impinging a hot air current using a hot air gun on the fabric while in an Instron tensile tester. A machine direction sample was clamped into jaws of an Instron tensile tester. The same continuous warp (MD) yarns were clamped into the upper and lower jaws in the tensile test configuration. Immediately upon applying a hot air stream to the fabric, the Instron chart recorder indicated an increase in tension. The increase in tension translates into a tendency for the fabric to shrink in the machine direction. Since the effect was immediate, there was insufficient time for the metal jaws of the Instron tester to warm up and contribute to this effect. When a WP-500-7A monofilament yarn was tested on equipment designed for the purpose under controlled conditions of temperature and tension, it was found that the yarn exhibited a linear coefficient of expansion of +0.07411% per 100° F. and a coefficient of expansion of diameter of +0.9557% per 100° F.

The fact that a woven fabric showed a tendency to shrink in the warp or machine direction, appeared to contradict the linear expansion property of the monofilament. It was discovered that the swelling in the filling yarn diameter was a contributing factor in the dimensional change of the woven fabric when heat was applied. A mathematical model of the fabric structure was developed to explain and predict the phenomenon.

Figure 3:
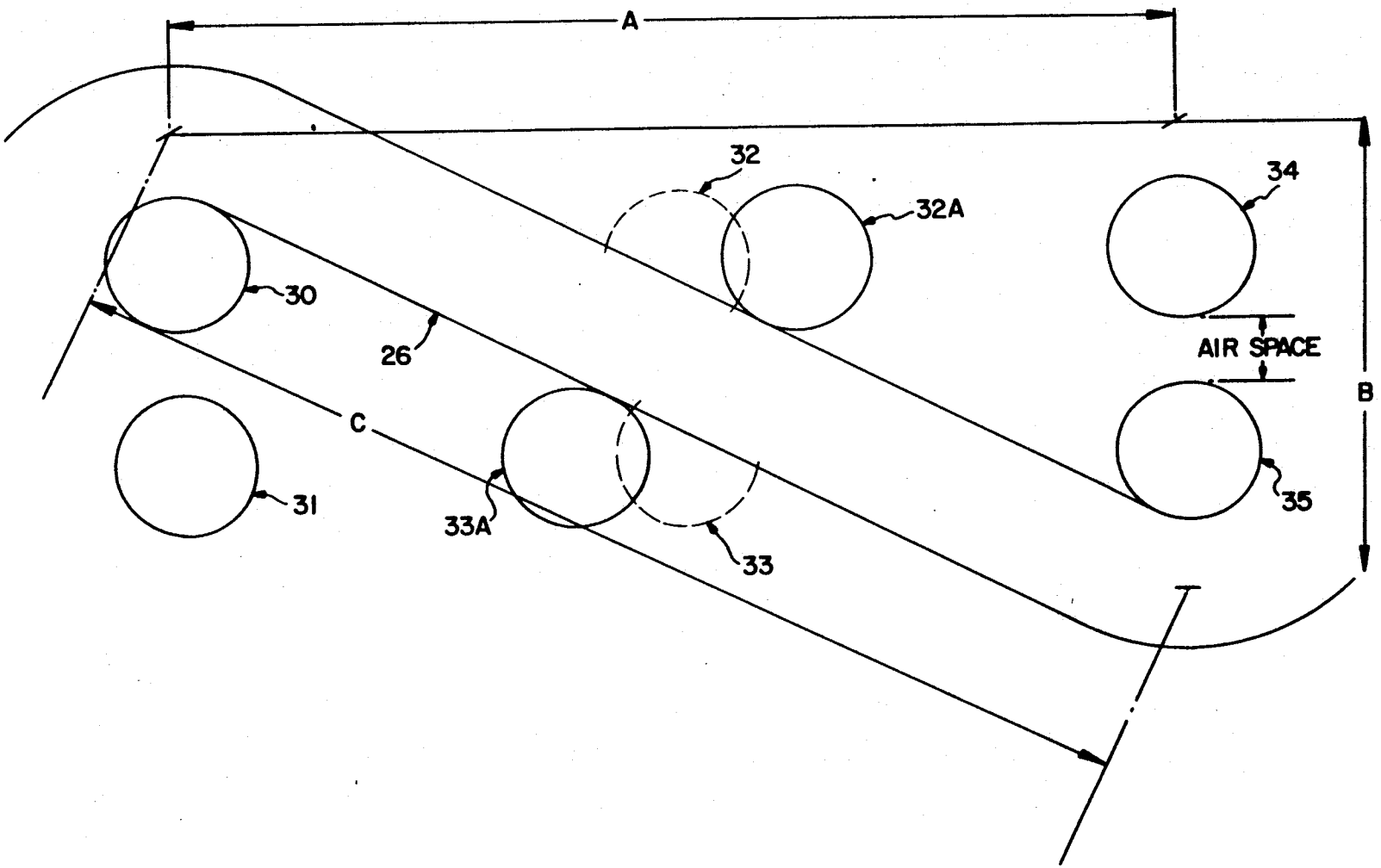
FIG. 3 is an enlarged cross-sectional view of section of the woven fabric woven shown in FIG. 2.

FIGS. 2 and 3 illustrate a fabric cross-section parallel to the machine direction of a papermakers fabric having 14 double picks per inch and a thickness of 0.06975 inches. A double pick is defined as one filling yarn atop of another such as CMD yarns 32, 33. In order for the CMD yarns designated by 32 and 33 to be accommodated into the fabric upon heat induced swelling, they must either move from the position shown in phantom in FIG. 3 to the position shown in FIG. 3 by 32*a* and 33*a* or the MD yarn 20 must be crimped slightly to fit into the cross-section. In practice, it appears that a combination of both occurs as evidenced from microscopic examination. Referring to FIG. 2, the distance "A", the length in the machine direction of a repeat, is easily determined by the equation:

$$A = \frac{\text{number of double picks per fabric diagonal}}{\text{double picks per inch}}$$

where "fabric diagonal" is defined as the hypotenuse "C" shown in FIG. 3

Knowing the fabric thickness by measurement and the diameter "d" of the MD and CMD yarns, the distance "B", the fabric thickness from centerline to centerline of the MD yarn is determined by:

$$B = dMD + 2(dCMD) + \text{air space}$$

where:

dMD=MD yarn diameter;

dCMD=CMD yarn diameter; and air space=fabric thickness−2(dMD+dCMD)

For example, a fabric having 14 double picks per inch, a thickness of 0.08975 inches and yarn diameter of both the MD and CMD yarns of 0.02 inches: A=0.14286 inches, air space=0.00975 inches and B=0.06975 inches.

Since $A^2+B^2=C^2$ for the right triangle formed by A, B and C, a fairly accurate approximation of the hypotenuse "C", the centerline length of a diagonal MD yarn, can be obtained by:

$$C = \sqrt{A^2 + B^2} = 0.15898 \text{ inches} = MD \text{ yarn length}$$

Yarn diameter and length thermal dimensional change data can easily be determined experimentally with suitable measuring instruments. Since yarns change in diameter and length due to heat and moisture, it was discovered that the length of the fabric on the machine would vary in relation to the degree of yarn diameter and length expansion as caused by variations in temperature and/or moisture profile across the fabric. For example, if the temperature difference between the edge of the fabric and the center of the fabric is 100° F., the mathematical model of the fabric structure can estimate the dimensional change for the fabric. The fabric length at the higher temperature can be calculated using the yarn diameter and length thermal dimensional expansion characteristic determined by experimental testing. At the increased temperature, the length at "C" becomes "C'" and is determined by:

$$C' = C + \Delta C = C + \left(C \cdot \frac{(KlMD \cdot 100^\circ \text{ F.})}{100}\right)$$

where fabric KlMD is the linear expansion of the MD yarn in terms of percent of growth per 100° F. For the fabric example given above this equals 0.15909 inches. The dimension B due to increase temperature of 100° F. is "B'".

$$B' = dMD + dMD\left(\frac{(KdMD \cdot 100^\circ \text{ F.})}{100}\right) + 2\left(dCMD + dCMD\left(\frac{(KdCMD \cdot 100^\circ \text{ F.})}{100}\right)\right) + \text{air space}$$

where:

KdMD is the diameter expansion characteristic of the MD yarns in terms of % growth per 100° F.; and KdCMD is the diameter expansion characteristic of the CMD yarns in terms of % growth per 100° F.

For the fabric example given above B'=0.070429 inches.

With respect to the fabric structure illustrated in FIGS. 2 and 3, the MD fabric length is expressed in terms of the MD and CMD yarns in accordance with the above as:

$$MD \text{ fabric length} = A = \sqrt{C^2 - B^2} = \sqrt{(MD \text{ yarn length})^2 - (dMD + dCMD + \text{air space})^2}$$

Accordingly, the percent change in fabric length per 100° F., % ΔMD fabric length, can be determined by:

$$\%\Delta MD \text{ fabric length} = \frac{\Delta A}{A} \cdot 100 = \frac{\sqrt{(C'^2 - B'^2} - A)}{A} \cdot 100$$

For the fabric example given above this value equals −0.10503. The negative value indicates that the fabric would shrink in length by 0.10503% when temperature is increased 100° F.

The linear and percent dimensional change for a set of yarns was determined by applying a tension of 3.5 pounds per linear inch to a system of yarns to simulate the tension in a papermaker's machine dryer section. After two cycles of preheating to 325° F. and cooling to remove residual shrinkage, the length of the yarns was recorded for a given temperature after 0, 5, 10 and 15 minutes. The yarn length was measured, and the percent change in length due to temperature was determined by regression analysis. While the change in length due to temperature for the tested yarns: polyester, nylon and polyester/nylon blend was a slightly non-linear relationship, a very high correlation coefficient was obtained from linear regression. Accordingly in the equation, a linear relationship was assumed.

Since the change in fabric or yarn length per degree of temperature change was desired, only relative values needed to be determined. Changes per 100° F. were chosen to express the equation in order to simplify the numbers. Because the relationship between dimensional change and temperature is almost linear in the temperature range tested, the stated equations for dimensional change per 100° F. can be easily adapted to the actual temperature variance across a fabric.

Even though Instron testing for polyester monofilament yarn showed a growth in length due to higher temperatures, a shrinkage in length was observed when testing the woven fabric with a hot air gun *and* when using the mathematical model. It was discovered that for this fabric and weave, the CMD yarn swelling in diameter due to high temperatures tends to require more length of MD yarn to wrap around enlarged filling CMD diameters and thus, the fabric tends to exhibit a shrinkage in length due to elevated temperatures.

In a similar manner, the calculated dimensional change of other polyester types of fabric was determined. The latter two fabrics had the same double picks per inch and warp and filling type. However, differences did exist in their calculated dimensional change. The results obtained are listed in Table 1 below. The calculated slack edges being based upon the assumption that the edges of the fabric were 100° F. cooler than the middle of the fabric.

| Type Yarn | | Calculated Change In Fabric Length/100° F. At 14 Double Picks | Slack Edges | | |
|---|---|---|---|---|---|
| Warp | Filling | (%) | Actual (%) | Calculated (%) | Difference (% Points) |
| WP500 | WP500 | −0.10503038 | 1.15 | 0.57 | −0.58 |
| WP500 | SVX | −0.29404506 | 2.26 | 3.70 | +1.44 |
| SVX | SVX | −0.42134792 | 6.67 | 5.81 | −0.86 |

A linear regression performed where the calculated dimensional change was the x variable and the slack edges was the dependent y value, showed that the resulting equation was:

$$\text{Slack Edges} = -16.5622x - 1.16935$$

with a very high correlation coefficient of 0.903. Thus it can be shown from the above that at a calculated dimensional change of −0.070603, no slack edges would be obtained.

In a similar fashion, the percent shrinkage due to temperature for another design fabric, FIG. 3, was determined, but with the exception that the warp consisted of 50% polyester, part A, and 50% nylon, part B, yarns and the effects of each MD yarn had to be considered. To do so, the percent dimensional change was first determined for the polyester alone and then for the nylon alone and the mathematical model was employed using an average of the two results. Table 2 shows the variables and calculated data for a variety of filaments and compares the estimate of slack edge occurrence to actual observed slack edge occurrence.

TABLE 2

| Fabric (No.) | MD Yarn A Diameter (In.) | MD Yarn A Type | MD Yarn B Diameter (In.) | MD Yarn B Type | CMD Yarn Diameter (In.) | CMD Yarn Type |
|---|---|---|---|---|---|---|
| 1. | 0.02 | a | 0.021 | d | 0.02 | a |
| 2. | 0.02 | b | 0.021 | d | 0.02 | b |
| 3. | 0.02 | a | 0.021 | d | 0.02 | b |
| 4. | 0.02 | c | 0.021 | d | 0.02 | b |
| 5. | 0.02 | c | 0.021 | d | 0.02 | e |

TABLE 2-continued

| Fabric (No.) | Calculated Change In Fabric Length/100° F. At 14 Double Picks (%) | Slack Edges Actual (%) | Slack Edges Calculated (%) | Difference (% Points) |
|---|---|---|---|---|
| 1. | −0.762183 | 2.44 | 2.69 | +0.25 |
| 2. | −0.790289 | 3.02 | 3.04 | +0.02 |
| 3. | −0.791564 | 3.10 | 3.05 | −0.05 |
| 4. | −0.780197 | 3.11 | 2.91 | −0.20 |
| 5. | −0.591211 | 0.60 | 0.57 | −0.03 |

Type a = Hoechst 20 mil PRNH Polyester
Type b = Shakespeare 20 mil SVX Polyester
Type c = Hoechst 20 mil M079 Polyester
Type d = DuPont 21 mil 7264-SA Nylon
Type e = Shakespeare 20 mil WP500-7A Polyester A linear regression performed where the calculated dimensional change was the x variable and the slack edges was the dependent y value, showed that the resulting equation was:

$$\text{Slack edges} = -12.3761407x - 6.7425691$$

with a correlation coefficient of 0.989, or an excellent correlation. Thus it can be shown form the above that for this design a calculated dimensional change of −0.5448056 no slack edges would be obtained.

Knowing that the mathematical model of the fabric structure successfully predicts the incidence of slack edges, the weave structure, warp and filling yarn diameter, warp and filling yarn dimensional change in length and diameter, polymer type, ends and picks per inch and air space can be varied independently or in combination with each other to produce a fabric that will minimize dimensional change of the fabric.

Additional analysis and testing has shown that by making the necessary trigometric adjustments due to fabric geometry, new models can be developed for complex weaves and structures. For example, the dimensional change of a spiral fabric structure can be determined and therefore the incidence of slack edges predicted. As a result adjustments in design can be made to manufacture fabrics that do not produce slack edges.

Figure 4:
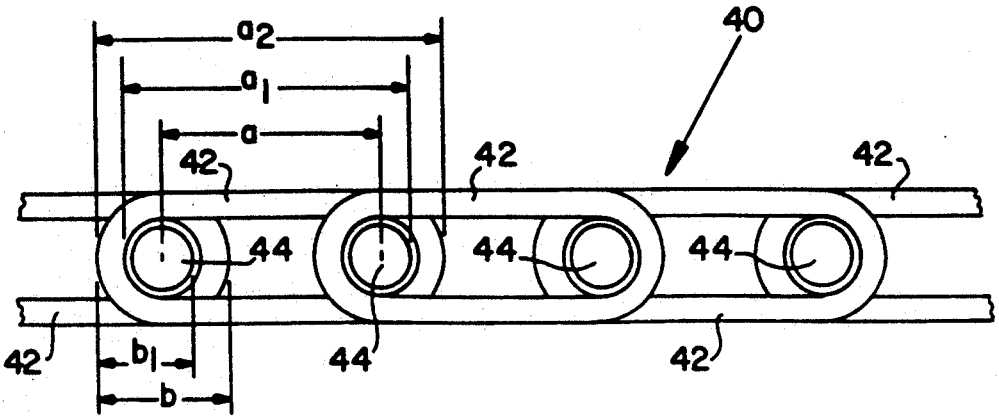
FIG. 4 is an enlarged cross-sectional schematic view of a section of a spiral fabric.

With reference to FIG. 4, there is shown a spiral fabric 40 comprised of helical yarns 42 which are intermeshed and serially linked together by pintle yarns 44. A mathematical model of this structure is easily defined by defining the machine direction repeat length of the fabric as the distance "a" between the center of one pintle to the center of the next pintle.

This formulation assumes the use of only one type of yarn for the pintle yarns and one specific type of spiral throughout the fabric. If, for example, the spiral structure is to be comprised of two different types of pintle yarns which alternate in joining every other pair of spirals together, the mathematical model would then be based on the distance spanning two spirals and their connecting pintles.

In the instant example the length of the fabric repeat selected is equal to the linear MD component of the spiral yarn, thus:

$$MD \text{ fabric length} = a = MD \text{ yarn length} = \frac{1}{\#\text{ of pintles per inch}}$$

However, the change in fabric length is a function of not only the linear expansion characteristic of the spiral yarn's MD component, but also is affected by the change in the diameters of both the spiral and pintle yarns represented as "b" in FIG. 4. In the spiral construction, the change in length of the MD component of the spiral yarns is counterbalanced by the change in diameter of both the spiral (MD) and pintle (CMD) yarns, for example:

$$\Delta MD \text{ fabric length} = \Delta a - \Delta b = (a \cdot KlMD) - (2(dMD \cdot KdMD) + (dCMD \cdot KdCMD))$$

The percent change in the machine direction lines of the fabric is then calculated based upon the dimensions and expansion characteristics of both the spiral and pintle yarns as defined above as follows:

$$\% \ \Delta MD \text{ fabric length} = \frac{\Delta MD \text{ fabric length}}{MD \text{ fabric length}} \cdot 100$$

The model reflects that a high rate of linear expansion is needed to overcome the negative effect of both spiral yarn and the pintle diameter. The model also reflects that pintles per inch effects the machine direction length a. Decreasing the number of pintles increases length a and the $\Delta a$ term assuming a positive linear expansion coefficient of the spiral yarns.

Since the expansion characteristic of the yarn diameter is a percentage, decreasing yarn diameter tends to decrease the $\Delta b$ term. Preferably, the pintle diameter is not less than 0.8 mm. Tensile strength is reduced with reduced pintle diameter. Tensile strength for spiral yarns is acceptable to less than 0.5 mm diameter. Spiral production is slowed because the wraps per inch increase from 36 to 54. However, overall weight, therefore, raw material cost, is reduced.

Alternative formulations of the mathematical model for the spiral construction depicted in FIG. 4 are possible. For example, one could contend that only the expansion of the diameter of one spiral yarn and the diameter of the one pintle yarn, represented by $b_1$, should be accounted for in calculating the change in MD fabric length. Thus, the $\Delta b$ term in the above-described mathematical model would be modified as follows:

$$\Delta b = (dMD \cdot KdMD) + (dCMD \cdot KdCMD)$$

It is also feasible to define the length of the fabric repeat, for which the percent change in fabric length is calculated, in more expanded terms. For example, the mathematical model could be based upon either the distance $a_1$ or $a_2$. If the mathematical model were to be based upon a machine direction length of $a_1$, the mathematical model could be modified as follows:

$$MD \text{ fabric length} = a_1 = (a + dCMD)$$

$$\Delta MD \text{ fabric length} = (KlMD)(a + dCMD) - (2(KdMD \cdot dMD) + (KdCMD + dCMD))$$

$$\% \ \Delta MD \text{ fabric length} = \frac{\Delta MD \text{ fabric length}}{a_1} \cdot 100$$

An even more comprehensive formulation of the fabric structure can be made by basing the machine direction fabric length upon the distance $a_2$. In such case, the expansion of both the top and bottom legs of the spirals can be accounted for resulting in the following variation in the formulation of the mathematical model:

$$MD \text{ fabric length} = a_2 = (a + dCMD + 2dMD)$$

$$\Delta MD \text{ fabric length} = 2(KlMD)(a + dCMD + 2dMD) - (2(KdCMD \cdot dCMD) + 2(KdMD \cdot dMD))$$

$$\% \ \Delta MD \text{ fabric length} = \frac{\Delta MD \text{ fabric length}}{a_2} \cdot 100$$

The particular formulation selected can be validated by constructing fabrics or analyzing previously constructed fabrics based upon the particular mathematical model, such as has been described in conjunction with the mathematical model relating to the woven fabric discussed in connection with FIGS. 2 and 3 above.

Spiral fabrics present unique problems in selecting yarns since the yarns must be susceptible to coiling. In use of polymeric monofilaments, relative elongation is inversely proportional to draw and shrinkage is proportional to draw in the manufacturing process. However, both the relative elongation and shrinkage values are effected by the heat set conditions used after drawing.

Historically, coilable yarns have had high shrink and high shrink force. It was recognized that those yarns which had low shrinkage yielded the best linear coefficients but were also yarns which did not produce acceptable coils. Through testing it was discovered that neither elongation or shrinkage is related to coiling. Heat set temperature was found to be the dominant factor.

The mathematical model illustrates that the machine direction, in this case a spiral yarn, should have a relatively low orientation such that its linear expansion characteristic is in the order of $+4.3 \cdot 10^{-4}$ per degree F.

The value of the use of the mathematical model in the design of papermakers fabrics is directly dependent upon uniformity of yarn performance. Since the expansion characteristics of the yarn can vary due to the manufacturing and processing of the yarn, it is important that the yarn used in the construction of a papermakers fabric be uniformly manufactured and processed.

A variety of processes and tests were conducted on yarns under consideration for construction of a spiral fabric. Of the four test methods employed, the preferred method entailed preshrinking the yarns in an oven at 400° F. for 1.2 minutes with no tension. Samples of these runs were attempted for residual shrinkage using normal quality control methods of 400° F. for 15 minutes. Samples were then mounted on the TST (Thermal Stability Tester) with 0.1 pounds per end and cycled to determine coefficient of linear expansion.

The yarn diameters were then measured with a laser micrometer. Diameters were measured before and at exposure to 300° F., and before and at exposure to 200° F. The average measured change of several cycles of exposure was used for determining the yarn's heat expansion characteristic.

In the environment of papermaking, papermakers fabrics are exposed to both wet and dry conditions as they are run on papermaking equipment. Whether the fabric remains essentially dry, wet or is sometimes wet and sometimes dry is dependent upon the fabric's position on papermaking equipment. For example, the last dryer fabric in the dryer section of a papermaking machine may run essentially dry at all times and the first wet press felt in the wet end of the papermaking machine may run essentially wet at all times. Accordingly, dependent upon the intended placement of a fabric, the effect of moisture fluctuation or moisture conditions can change the heat expansion characteristic of the particular yarn and, accordingly, the papermakers fabrics.

In order to determine the heat expansion characteristics of the yarns in relation to the moisture conditions in the papermaking process, the above testing was modified to determine heat expansion characteristics of yarns and fabrics as a dry yarn and/or fabric was wetted while the temperature was increased 100° F. Also, a determination was made of expansion characteristics of wet yarns and/or fabrics and maintaining wet conditions through the 100° F. change of temperature during cycling. As with a dry test method, the average measured change of several cycles of the dry/wet testing and the wet/wet testing was used for determining the yarn's dry/wet heat expansion characteristic and wet/wet heat expansion characteristic, respectively.

In constructing a spiral fabric based upon the above mathematical model, the finishing of the fabric through heat setting should be considered. Preferably, a spiral fabric is finished through an oven where the fabric is suspended in hot air to attain a finishing temperature of approximately 400° F. to remove residual shrinkage of the yarns. Heat setting a spiral fabric on a heated cylinder is not as effective in removing the residual shrinkage. It was discovered that the more shrinkage removed, the greater the linear expansion characteristics of the yarn which the mathematical model indicates is desirable for spiral fabric constructions.

Irrespective of which type of finishing processing is utilized, the determination of the expansion characteristics of the yarn should account for all processing of the yarns during both the manufacture of the yarn as well as the finishing of the papermakers fabric. Best results will be achieved where the finished fabrics actually employ yarns having dimensions and expansion characteristics which correspond to those used in the mathematical model.

We claim:

1. A method of manufacturing a papermakers fabric in order to avoid slack edges and other dimensional stability problems, the fabric for use in a predetermined environment where the fabric is subject to temperature and/or humidity changes, the method allowing unlimited variability in the selection of materials and dimensions of yarns, the method comprising:

(a) selecting a fabric repeat structure having a MD yarn component and a CMD yarn component;

(b) formulating the percent change in machine direction dimension of a repeat of the fabric as a function having as variables at least the length and length expansion characteristics of the MD component and the cross-section and cross-sectional expansion characteristic of the CMD yarn component; and (c) selecting yarns having linearly projectable length and cross-sectional expansion characteristics within the predetermined environment for the MD component and for the CMD components, said selected yarns having respective length and cross-sectional dimensions and respective length and cross-sectional expansion characteristics such that the percent change of the machine direction dimension of the repeat of the fabric calculated by substituting the length and diameter dimensions and respective length and cross-sectional expansion characteristics of said selected yarns for the corresponding variables of said function is in the range of ±0.4% per 100° F. change in temperature.

2. A method of manufacturing a papermakers fabric according to claim 1 wherein the calculated percent change of the machine direction dimension of the repeat of the fabric based on said defined function is in the range of ±0.2% per 100° F. change in temperature.

3. A method of manufacturing a papermakers fabric according to claim 1 wherein the calculated percent change of the machine direction dimension of the repeat of the fabric based on said defined function is in the range of ±0.2% per 100° F. change in temperature at 100% humidity.

4. A method of manufacturing a papermakers fabric in order to avoid slack edges and other dimensional stability problems, the fabric for use in a predetermined environment where the fabric is subject to temperature and/or humidity changes, the method allowing unlimited variability in the selection of materials and dimensions of yarns, the method comprising:

(a) selecting a fabric repeat structure having a MD yarn component and a CMD yarn component;

(b) formulating the percent change in machine direction dimension of a repeat of the fabric as a function having as variables at least the length and length expansion characteristics of the MD component and the cross-section and cross-sectional expansion characteristic of the CMD yarn component; and (c) selecting a stability range for the percent change of machine direction fabric repeat dimension including:

(i) selecting a temperature range, (ii) testing at least one fabric sample made of yarns having linearly projectable length and cross-sectional expansion characteristics having said selected fabric structure to determine the actual percent change of machine direction dimension of the fabric sample over said selected temperature range, and (iii) determining a calculated percent change of machine direction fabric repeat dimension to define said stability range in accordance with said function, calculated by substituting the length and cross-section dimensions and respective length and cross-sectional expansion characteristics of the yarns comprising said fabric sample, for the corresponding variables of said function, (d) selecting yarns having linearly projectable length and cross-sectional expansion characteristics within the predetermined environment for the MD component and for the CMD component, said yarns having respective length and cross-section dimensions and respective length and cross-sectional expansion characteristics such that the percent change of the machine direction dimension of the fabric calculated by substituting the length and cross-section dimensions and respective length and cross-sectional expansion characteristics of said selected yarns for the corresponding variables of said function is within said selected stability range.

5. A method of screening yarns for the construction of a papermakers fabric in order to avoid slack edges and other dimensional stability problems, the fabric for use in a predetermined environment where the fabric is subject to temperature and/or humidity changes, the fabric having a selected repeat structure which includes at least one MD yarn component and at least one CMD yarn component, the yarns having linearly projectable length and cross-sectional expansion characteristics within said predetermined environment, said method allowing unlimited variability in the selection of materials and dimensions for MD and CMD yarns, the method comprising:

formulating an equation for the percent change of machine direction length of a repeat of the selected fabric structure as a function having as variables at least the length expansion characteristic of the MD yarn component and the cross-sectional expansion characteristic of the CMD yarn component;

selecting a first type of yarn for the MD component of the yarn structure and determining the projectable length expansion characteristic of said first type of yarn within the predetermined environment;

selecting a second type of yarn for the CMD component of the yarn structure and determining the projectable cross-sectional expansion characteristic of said second type of yarn within the predetermined environment;

substituting the determined value for the length expansion characteristic of said first type of yarn for said MD length expansion variable and the determined value for the cross-sectional expansion characteristic of said second type of yarn for said MD cross-sectional expansion variable to thereby calculate the theoretical percentage change of machine direction length of the fabric structure repeat in accordance with said formula; and determining whether said calculated value is within a selected range to thereby predict whether said selected combination of first and second types of yarns as the respective MD and CMD yarn components of the selected fabric repeat structure will result in a dimensionally stable fabric when a fabric is woven in said selected structure using said first and second types of yarns as the respective MD and CMD yarn components.

6. The method according to claim 5 wherein the second type of yarn is selected to be the same as the first type of yarn.

7. A method according to claim 5 wherein:

the selected fabric repeat structure comprises a double pick woven fabric structure having MD yarns interwoven with two stacked layers of CMD yarns such that the MD yarns weave over a pair of stacked CMD yarns, between the next pair of stacked CMD yarns, under the next pair of stacked CMD yarns, between the next pair of stacked CMD yarns and thereafter repeat;

said equation is formulated to be:

$$\% \Delta MD \text{ fabric length} = \frac{\Delta A}{A} \cdot 100 = \frac{\sqrt{(C^2 - B^2 - A)}}{A} \cdot 100$$

$$A = \frac{2}{\text{stacked pick pairs per inch}}$$

$$B = dMD + 2(dCMD) + \text{air space}$$

where:

$dMD = MD$ yarn diameter;

$dCMD = CMD$ yarn diameter; and

-continued $$\text{air space} = \text{fabric thickness} - 2(dMD + dCMD)$$

$$C = \sqrt{A^2 + B^2} = 0.15898 \text{ inches} = MD \text{ yarn length}$$

$$C' = C + \Delta C = C + \left(C \cdot \frac{[KLMD \cdot 100^\circ \text{ F.}]}{100}\right)$$

where: KlMD is the length expansion of the MD yarn in terms of percent of growth per 100° F.;

$$B' = dMD + dMD\left(\frac{[KdMD \cdot 100^\circ \text{ F.}]}{100}\right) + 2\left(dCMD + dCMD\left[\frac{(KdCMD \cdot 100^\circ \text{ F.})}{100}\right]\right) + \text{air space}$$

where: KdMD is the diameter expansion characteristic of the MD yarns in terms of % growth per 100° F.; and KdCMD is the diameter expansion characteristic of the CMD yarns in terms of % growth per 100° F.; and the selected range is ±0.4%.

8. A method according to claim 5 wherein:

the selected fabric repeat structure comprises a spiral fabric structure having spiral yarns defining the MD yarn component which are intermeshed and serially interconnected by pintle yarns which define the CMD yarn component;

said equation is formulated to be:

$$\% \Delta MD \text{ fabric length} = \frac{\Delta MD \text{ fabric length}}{MD \text{ fabric length}} \cdot 100$$

$$MD \text{ fabric length} = a = MD \text{ yarn length} = \frac{1}{\text{of pintles per inch}}$$

$$\Delta MD \text{ fabric length} = \Delta a - \Delta b = (a \cdot KLMD) - (2(dMD \cdot KdMD) + (dCMD \cdot KdCMD))$$

where:

dMD=MD yarn component diameter;

dCMD=CMD yarn component diameter;

KlMD=the length expansion of the MD yarn component;

KdMD=the diameter expansion of the MD yarn component;

KdCMD=the diameter expansion of the CMD yarn component;

and wherein the selected range is ±0.4%.

9. A method for making a papermakers fabric using the screening method according to claim 5 comprising repeatedly selecting different combinations of yarn types for said first yarn type and said second yarn type until a selected combination of said first and second yarn types results in a calculated percent change of machine direction repeat length within said selected range and thereafter using said selected combination of yarn types to construct a papermakers fabric having said selected repeat structure.

10. A method according to claim 5 wherein the selected repeat structure includes a second CMD yarn component, the method further comprising:

formulating an equation for the percent change of machine direction length of a repeat of the selected fabric structure as a function having as variables at least the length expansion characteristic of the MD yarn component, the cross-sectional expansion characteristic of the CMD yarn component and the cross-sectional expansion characteristic of the second CMD yarn component;

selecting a third type of yarn for the second CMD component of the repeat structure and determining the projected cross-sectional expansion characteristic of said third type of yarn within the predetermined environment;

substituting the determined value for the length expansion characteristic of said first type of yarn for said MD length expansion variable, the determined value for the cross-sectional expansion characteristic of said second type of yarn for said CMD cross-sectional expansion variable, and the determined value for the cross-sectional expansion characteristic of said third type of yarn for said second CMD diameter expansion variable to thereby calculate the theoretical percentage change of machine direction length of the fabric structure repeat in accordance with said formula; and determining whether said calculated value is within a selected range to thereby predict whether said selected combination of first, second and third types of yarns as the respective MD and CMD yarn components of the selected fabric structure will result in a dimensionally stable fabric when a fabric is woven in said selected repeat structure using said first, second and third types of yarns as the respective MD and CMD yarn components.

11. The method according to claim 10 wherein:

the selected fabric repeat structure comprises a spiral fabric structure having spiral yarns defining the MD yarn component which are intermeshed and serially interconnected by pintle yarns which define the CMD yarn components; and the third type of yarn is selected to be different from the second type of yarn to reflect two different yarns being used alternatively as pintle yarns in said selected fabric repeat structure whereby the fabric repeats after every two serially connected spirals.

* * * * *

UNITED STATES PATENT AND TRADEMARK OFFICE

CERTIFICATE OF CORRECTION

PATENT NO. : 5,240,763

DATED : August 31, 1993

INVENTOR(S) : J. Robert Wagner, et al.

It is certified that error appears in the above-identified patent and that said Letters Patent is hereby corrected as shown below:

At column 1, line 13, delete "," after "generally".

At column 1, line 66, after "produced" insert --.--.

At column 8, line 42, delete

"$= \frac{\sqrt{(C'^2 - B'^2} - A)}{A} \cdot 100$"

and insert therefor

-- $= \frac{(\sqrt{C'^2 - B'^2} - A)}{A} \cdot 100$--.

At column 10, line 24, delete "form" and substitute therefor --from--.

At column 11, lines 9-11, delete

"ΔMD fabric length= Δa - Δb-

=(a•KlMD)-(2(dMD•KdMD)+(dCMD•KdCM-

D))"

and substitute therefor

--ΔMD fabric length= Δa - Δb

=(a•KlMD)-(2(dMD•KdMD)+(dCMD•KdCMD))--

At column 15, line 29, delete "said MD" and insert therefor --said CMD--.

UNITED STATES PATENT AND TRADEMARK OFFICE

CERTIFICATE OF CORRECTION

PATENT NO. : 5,240,763

DATED : August 31, 1993

INVENTOR(S) : J. Robert Wagner, et al.

It is certified that error appears in the above-identified patent and that said Letters Patent is hereby corrected as shown below:

At column 15, line 58, delete $$" = \frac{\sqrt{(C'^2 - B'^2 - A)}}{A} \cdot 100"$$

and insert therefor $$-- = \frac{(\sqrt{C'^2 - B'^2} - A)}{A} \cdot 100--.$$

At column 16, line 40, delete " . of pintles per inch"

and insert therefor --# of pintles per inch--

Signed and Sealed this

Twenty-sixth Day of April, 1994

Bruce Lehman

*Attest:*

BRUCE LEHMAN

*Attesting Officer*

*Commissioner of Patents and Trademarks*